United States Patent [19]

Mondor, III

[11] Patent Number: 4,741,707

[45] Date of Patent: May 3, 1988

[54] METHOD AND WOVEN CABLE TERMINATION WITH INSULATION DISPLACEABLE CONNECTOR

[75] Inventor: E. J. Mondor, III, Greenville, S.C.

[73] Assignee: Woven Electronics Corporation, Greenville, S.C.

[21] Appl. No.: 830,725

[22] Filed: Feb. 19, 1986

[51] Int. Cl.[4] ..... H01R 4/24

[52] U.S. Cl. ..... 439/417; 174/117 M

[58] Field of Search ..... 339/97 R, 97 P, 98, 339/99 R; 174/117 M

[56] References Cited

U.S. PATENT DOCUMENTS

| | | | |
|---|---|---|---|
| 3,447,120 | 5/1969 | Rask et al. | 174/117 M |
| 4,073,560 | 2/1978 | Anhalt et al. | 339/99 R |
| 4,153,325 | 5/1979 | Asick | 339/99 R |
| 4,168,201 | 10/1966 | Townsend | 339/99 R |
| 4,508,401 | 4/1985 | Casciotti et al. | 174/117 M |

*Primary Examiner*—Joseph H. McGlynn
*Attorney, Agent, or Firm*—Cort Flint

[57] ABSTRACT

A method and woven structure for terminating a woven cable are disclosed wherein termination sections B are woven in continuous cabling 10 and spaced apart to define sections of individual woven cable A. In termination section B, ground wires 14 are floated above the plane of the woven cable and outside of the weave pattern. Signal conductors 12 are woven through the cabling with center-lines of adjacent conductors being fixed by the weave pattern. In the method, the ground wires are severed and terminated to a common bus bar 20. Next, an insulation displaceable connector C, of the type typically used with extruded cabling, is inserted in the weave portion 18 whereby the prongs of the insulation displaceable connector pierce and displace the insulation on the signal conductors 12. Bus bar 20 is electrically connected to a pin 24 of the insulation displaceable connector by means of a pigtail or other wire 26. Next, the cabling is folded over a bridge bar 30 of the connector and fixed in place by a strain relief bar 32 in a manner that a compact well-terminated end of woven cable A may be had in a simplified expedient manner in accordance with the invention.

18 Claims, 3 Drawing Sheets

Fig. 4
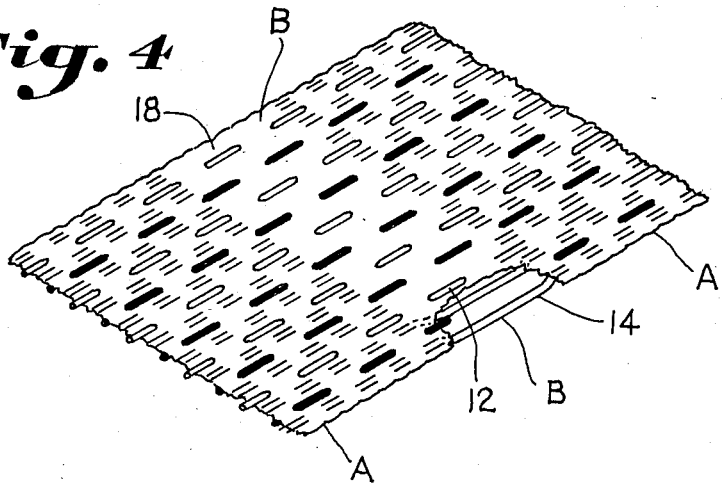
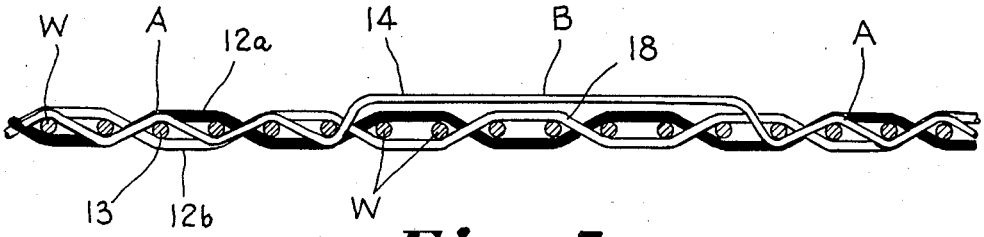
Fig. 5.
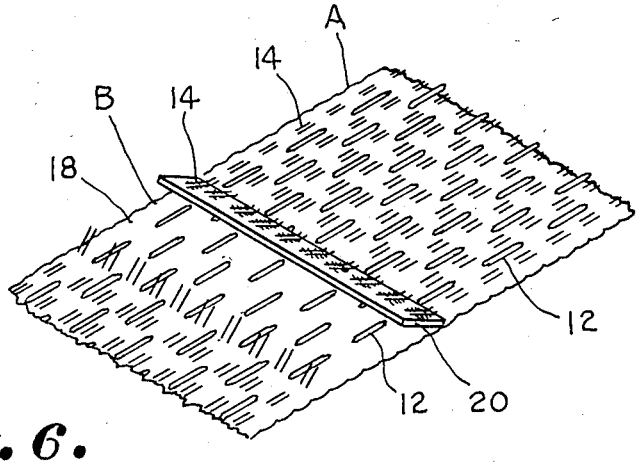
Fig. 6.

METHOD AND WOVEN CABLE TERMINATION WITH INSULATION DISPLACEABLE CONNECTOR

BACKGROUND OF THE INVENTION

The invention relates to a method and woven structure for terminating a multiconductor woven flat cable. The problem is that in conventional termination of woven multiconductor cables, it has been necessary to weave break-out sections in which both the ground conductors and signal conductors are floated from the weave in a prescribed manner so that the conductors may be identified. The breakout sections may be woven in continuous runs of woven cabling which are then severed for producing individual cables. The conductors are soldered to the individual contacts of the terminal connectors. This process is both tedious and time consuming requiring a good bit of labor and materials.

It has been known in the case of extruded and laminated cabling in which electrical conductors are embedded in a polymeric material to utilize a terminal connector commonly referred to as an insulation displaceable connector. The insulation displaceable connector includes sharpened prongs which insert in the polymeric material to pierce the insulation of the conductors for electrical termination. This type of connector has been utilized mainly for extruded cable imbedded in polymeric material since the center-to-center spacing of the conductors in such a method and construction may be accurately fixed in a manner that the prongs of the connector spaced likewise reliably pierce the conductors.

U.S. Pat. No. 4,005,921 discloses an electrical connector for a flat multi-conductor transmission cable of the type including parallel conductors embedded in a sheath material. The sheath material is severed and slid forward to expose the conductors, and a connector is provided which is connected to the conductors in a manner that would not be particularly suitable for woven cabling. Soldering of the conductors is additionally required.

Accordingly an object of the invention is to provide a method and woven structure for terminating a woven flat multiconductor cables which reduces the labor and material involved in the termination process.

Accordingly, it is an important object of the present invention to provide a method and woven structure for terminating a woven multiconductor cable without the need of soldering the signal conductors to the terminal connector.

Still another important object of the present invention is to provide a method for weaving a cable by which termination means of an insulation displacement connector may easily and reliably be made.

Another object of the invention is to provide a woven construction for flat multiconductor cable which enables it to be terminated in a relatively quick and easy manner by utilizing an insulation displacement type terminal connector.

SUMMARY OF THE INVENTION

The above objectives are accomplished according to the present invention by weaving a flat multiconductor cable in a weave pattern with the ground conductors floated out of the weave pattern at termination sections. The weave of the signal conductors is continued through the termination section. Preferably there is a cut-line section following the termination section wherein the ground and signal conductors are woven in the weave pattern in their exact center-to-center spacing. By severing the cable across the termination section, the ground conductors are freed for soldering to a bus bar. An insulation displacement connector may then be inserted into the woven cable to pierce the insulation of signal conductors, preferably by pressing the connector through the cut-line section of the cable next adjacent the terminal section. Because the signal conductors have been fixed with a precise described spacing between their center lines in the weave pattern, it has been found that an insulation displaceable connector (IDC) may reliably be utilized in lieu of soldering with the ground wires removed from the weave pattern. The ground bar may be pigtailed or otherwise electrically connected to a pin of the IDC connector. The bus bar and overlying cable in the terminal section are then folded over the IDC connector, and the strain relief bar utilized to clamp the cable and bus bar firmly to the connector providing both a compact configuration in which the bus bar is nested and strain relief. The remaining woven cable is then severed across the width of the cut-line section.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is an enlarged perspective view of the termination section of FIG. 1 from the reverse side of the cabling;

FIG. 5 is a sectional view taken along line 5—5 of FIG. 3;

FIG. 6 is a perspective view illustrating the method of a woven cable of the present invention wherein a termination section has been severed for terminating the ground conductors;

DETAILED DESCRIPTION OF A PREFERRED EMBDODIMENT

Figure 1:
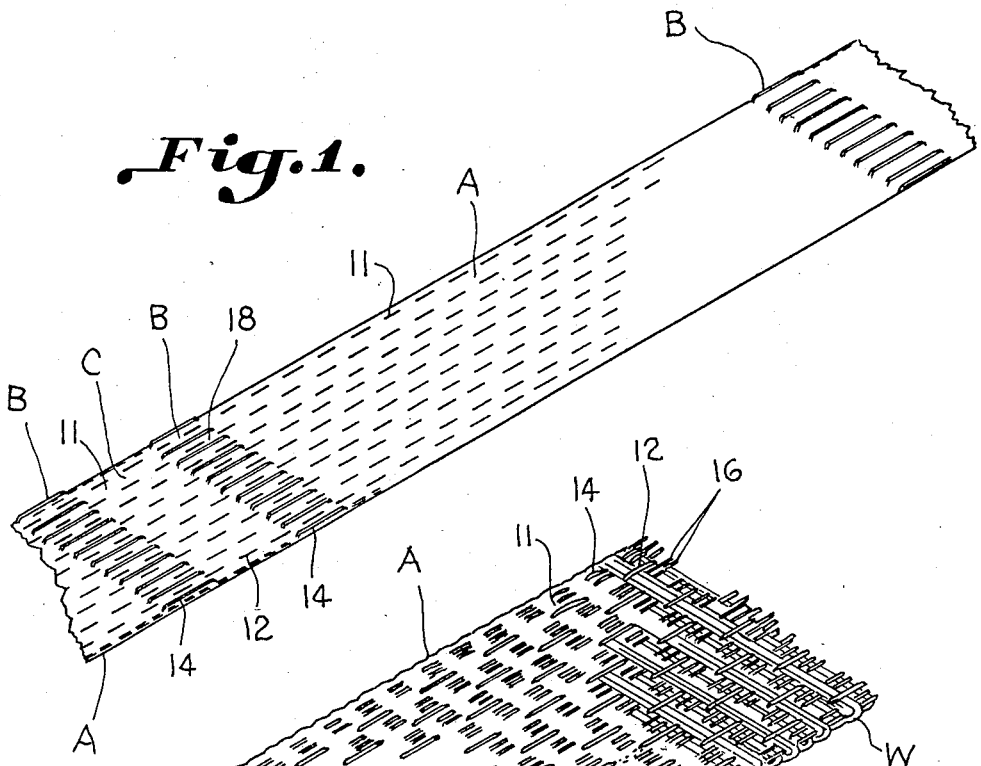
FIG. 1 is a perspective view of continuous length woven cabling which consists of woven cable having termination sections woven in accordance with the present invention.

Referring now to the drawings, a straight run of woven cabling is illustrated generally at 10 which includes an individual section of flat woven cable A woven at intervals along the continuous run cabling. At the ends of each cable A are termination sections B woven at spaced intervals along the length of cabling 10.

Preferably, there is a cut-line section C at each side of termination section B opposite woven cable A. There will be about a two inch cut-line section C between termination sections B at opposing ends of adjacent woven cable A.

The continuous cabling is cut across the cut-line section C and termination sections B, in a manner to be more fully described hereinafter, to provide a number of individual woven cables A.

Figure 2:
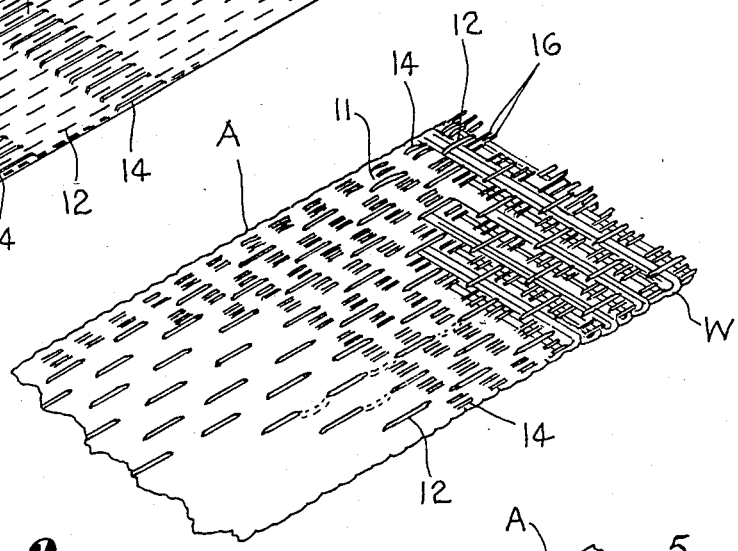
FIG. 2 is an enlarged perspective view of the woven cable of FIG. 1.
Figure 3:
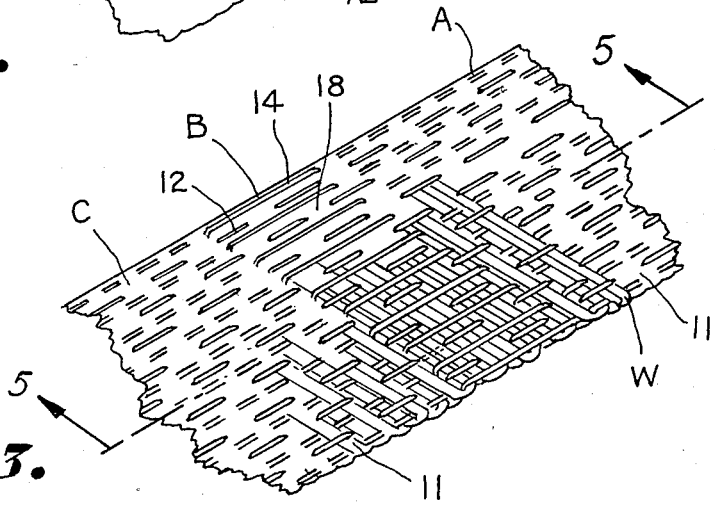
FIG. 3 is an enlarged perspective view of the termination section of FIG. 1.

Referring now in more detail to FIGS. 1–6, the construction of woven cable A and the continuous run cabling 10 will be described in more detail. The woven cable A includes a plurality of warp elements woven with a weft element W in a prescribed weave pattern 11 in the woven cable. The warp elements include a plurality of insulated signal conductors 12 and ground conductors 14 extending in a warp direction in the weave pattern in a generally juxtaposed manner. Further included is warp yarns 16 which extend generally parallel between the ground conductors and signal conductors in between the ground conductors to fix, along with the other weave elements, the center line spacing of the warp signal conductors 12 in the weave pattern and cable. Warp yarns 16 are illustrated in FIG. 6, but omitted in the remaining drawings for purposes of clarity. The ground conductors 14 are also fixed in their spacing by the weave. This is particularly important in the case of the present invention wherein the center-to-center or center line spacing of the signal conductors must be maintained within prescribed tolerances in a manner that an insulation displaceable connector, D, (IDC) accurately engages the conductors to pierce and displace the insulation 13 thereon to make electrical contact.

Typical insulated signal conductors 12 are 28 or 30 gauge with polyurethane or Teflon insulation 13.

Weft yarn W is woven to and fro across the cable width. The cable illustrated, having been woven on a needle loom, includes knitted selvages at 20 and 22. The wet yarn W is interwoven with the warp conductors and yarn and the warp conductors undulate in a prescribed pattern. Preferably, the adjacent signal conductors such as **12*a* and 12*b* undulate 180 degrees out of phase with each other (FIG. 5). The signal conductors weave over two picks and under two picks of weft element W. The ground conductors 14** are woven over one pick and under one pick of the weft element. By the woven construction of the warp yarns and the weft yarns, the signal conductors have their center lines fixed in a reliable geometrical configuration in the cable for good contact with the IDC.

Reference may be had to U.S. Pat. No. 4,143,236 for more detailed descripton of the cable, which disclosure is hereby incorporated herein by reference. It is to be understood, of course that other weave patterns may also be utilized with the invention.

Figure 7:
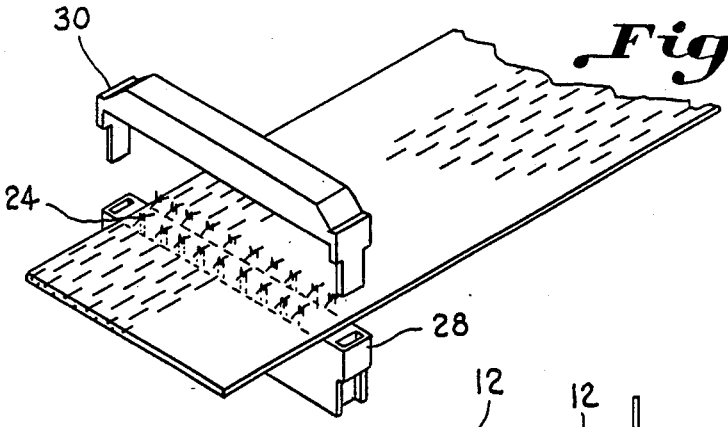
FIGS. 7 and 8 are illustrations of an insulation displaceable connector being utilized to terminate a woven cable in accordance with the method and construction of the present invention.
Figure 8:
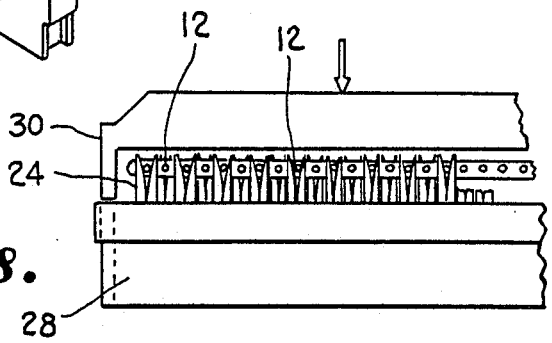
Figure 9:
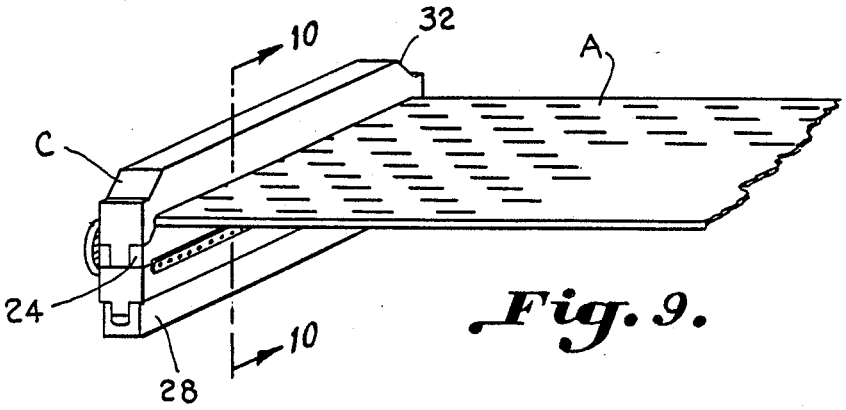
FIG. 9 is a perspective view illustrating a woven cable terminated in accordance with the method and construction of the present invention.
Figure 10:
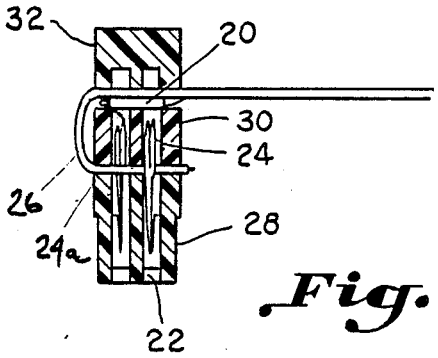
FIG. 10 is a sectional view taken along line 10—10 of FIG. 9.

Referring now to termination sections B, as best illustrated in FIGS. 3–6, it can be seen that each termination section B includes the ground conductors 14 floated out of standard weave pattern 11 of cable A with signal conductors 12 remaining in weave pattern 18. In this manner, the ground conductors may be cut across the termination section leaving the ground conductors free for termination while leaving the signal conductors bound in weave pattern 18 with their center line spacing maintained. Thereafter the ground and signal conductors are again woven in pattern 11 in cut-line section C. For example, with 50 mil spacing between adjacent conductors, a standard 50 mil IDC may be utilized as illustrated in FIGS. 7–10.

The ground conductors 14 are floated out of weave pattern 11 for a sufficient distance so that a blade may be inserted between the ground conductors and the cables for cutting only ground conductors 14. Ground conductors 14 are cut at both ends of cable A, preferably without cutting through weave section 18.

The free ends of the ground wires 14 are soldered to ground means in the form of a bus bar 20 extending across termination section B on both ends of cable A.

Preferably the IDC is inserted in the weave pattern 11 of cut-line section C next adjacent termination section B. The signals will be more reliably fixed in their center line spacing in weave pattern 11 rather than weave pattern 18. The ground wires in weave pattern 18 of cut-line section may be contacted and damaged by insertion of the IDC; however, these conductors will be dead once severed in termination section B.

The IDC typically includes pin sockets 22 which mate with terminal pins of a complimentary connector (not shown). There is a plurality of insulation displaceable V-shaped prongs 24 which receive and cut through the insulation 13 of an insulated conductor displacing the same so that the prongs make electrical conduct with the conductors. As can best be seen in FIG. 8, base 28 of the IDC carries prongs 24 which are embedded in the woven cable and signal conductors 12 fixed on 50 mil centers. The prongs of the connector displace the insulation of the individual conductors whereby electrical connection is made across the entire width of the cable with each conductor on center. A bridge 30 is pressed in place on the opposing side of cable A. The bus bar 20 is then connected to a pin socket of the IDC by means of a pigtail connector 26, or any other suitable electrical connector, attached, for example to prong **24*a*. Alternately, one of the ground conductors may be terminated longer then the others and the extended length routed to the pin after soldered sectionally to bus bar 20. The cable is then folded over bridge 30 of the IDC and a strain relief tab 32 is clipped in place with the bus bar folded against the cable and against the bridge 30 of the IDC. In this compact configuration the bus bar is enclosed and housed between the bridge 30, cable A, and bar 32**. A compact well-terminated construction is had for the cable. The opposite end of the cable may be terminated in an identical manner.

While preferred embodiment of the invention has been described using specific terms, such description is for illustrative purposes only, and it is to be understood that changes and variations may be made without departing from the spirit or scope of the following claims.

What is claimed is:

1. The method of terminating a flat woven multi-conductor electrical transmission cable having a plurality of signal conductors fixed in a first weave pattern which includes a weft element in said cable with a prescribed spacing between the center lines of adjacent conductors and a number of ground conductors woven in said cable wherein the improvement comprises weaving a termination section in which said signal conductors are bound with said warp and weft yarns in a second weave pattern and said ground conductors are unbound with said warp and weft yarns, floating said unbound ground conductors out of said second weave pattern while maintaining said prescribed spacing of said signal conductors fixed in said second weave pattern, terminating said ground conductors to a ground plane, inserting an insulation displaceable connector into said woven cable in a manner that said signal conductors are engaged so that the insulation on said signal conductors is pierced and displaced, and connecting said ground plane to a selected pin of said insulation displaceable connector.

2. A method of producing individual flat woven electrical transmission cables having a plurality of signal conductors and ground conductors arranged in a general juxtaposed manner across said woven cable with a prescribed spacing between adjacent signal conductors fixed by a first weave pattern of said woven cable which includes a weft element, said method being of the type wherein a continuous length of cabling is woven consisting of said woven cable with termination sections formed at described spaced intervals along the length of said continuous cabling to define ends of individual woven cables wherein the method comprises terminating said cable by the steps of:

weaving a termination section in which said signal conductors are bound with said warp and weft yarns in a second weave pattern and said ground conductors are unbound with said warp and weft yarns;

floating said unbound ground conductors above said second weave pattern in said termination sections;

weaving said signal conductors in said second weave pattern through said termination sections in a manner that said prescribed spacing of said signal conductors is generally maintained;

severing said ground conductors across said termination sections;

terminating said ground conductors at a ground means out of the plane of said woven cable;

inserting an insulation displacement connector into said woven cable adjacent said terminated ground conductors in a manner that said insulation of said signal conductors is pierced and displaced by the prongs of said insulation displaceable connector at said center line spacings; and electrically connecting said ground means to said insulation displaceable connector.

3. The method of claim 2 including weaving a cut-line section adjacent each said termination section consisting of said ground conductors and signal conductors interwoven in said weave pattern.

4. The method of claim 2 wherein said ground means includes a bus bar extending transversely of said cable to which said ground conductors are electrically connected.

5. The method of claim 2 including said woven cabling across each said termination section to produce terminated individual woven cable.

6. The method of claim 2 wherein warp and weft yarns are interwoven with said signal and ground conductors in said weave pattern to fix the prescribed spacing between the center lines of said signal conductors.

7. The method of claim 6 wherein said ground conductors are terminated by connecting said bus bar to a desired terminal pin socket of said insulation displaceable connector.

8. A method of producing individual flat woven electrical transmission cables having a plurality of conductors ranged generally in a juxtaposed manner across the cable said method being of the type wherein a continuous length of woven cabling is woven in a first weave pattern which includes a weft element with said continuous length of cabling being severed across termination sections of said cabling which correspond to ends of said individual woven cable wherein the improvement comprises terminating each said individual woven electrical transmission cable by inserting an insulation displaceable connector into said woven cable in a manner that the prongs of said insulation displaceable connector pierce the insulation of said signal conductors at said prescribed spacing of their center lines, and severing said individual cables at their termination section to produce individual woven cables.

9. The method of claim 8 wherein said termination sections include only electrical signal conductors woven in said cable in which said insulation displaceable is inserted.

10. The method of claim 9 including warp and weft yarns interwoven with said electrical signal conductors fixing said prescribed spacing of said signal conductors in said weave pattern of said woven cable.

11. A flat woven electrical transmission cable having multiple signal and ground conductors arranged generally side-by-side across said cable bound by a weft element and a plurality of warp elements in a first weave pattern wherein the improvement comprises an insulation displaceable connector of the type having pin sockets and having termination prongs which pierce and penetrate said signal conductors in a second weave pattern of said woven cable consisting only of said signal conductors woven with said weft and warp elements without said ground conductors; said prongs displacing the insulation on said signal conductors and terminating said cable at opposing ends; ground means connected to said ground conductors of said cable; and means for connecting said ground means to said insulation displaceable connectors.

12. The woven cable of claim 11 wherein said ground means includes a ground bus bar extending transversely of said woven cable connected to said ground connectors, and said connecting means includes an electrical connection between said bus bar and a selected one of said pin sockets of said insulation displaceable connector at each end of said woven cable.

13. A flat woven electrical transmission cable having a first weave pattern which includes a weft element in which multiple conductors are arranged generally side-by-side across the width of the cable, a number of said conductors being insulated signal conductors woven with a prescribed spacing fixed between the center lines of adjacent conductors by said first weave pattern; and an insulation displaceable connector of the type having pin sockets for connecting with pin terminals and termination prongs inserted in opposing ends of said woven cable for piercing insulation of said signal conductors in a manner in which said prongs engage said signal conductors at said prescribed center-line spacings to pierce and displace the insulation of said conductors and terminate said signal conductors at opposing ends of said woven cable.

14. The woven cable of claim 13 wherein said woven cable includes a number of ground conductors woven in said weave pattern of said woven cable; and said ground conductors being terminated by ground means external of said insulation displaceable connector.

15. The cable of claim 14 wherein said ground means includes a bus bar extending transversely of said woven cable, and connector means for electrically connecting said bus bar to a selected one of said pin sockets of insulated displaceable connector for termination to a common ground.

16. A method of terminating a flat woven electrical cable of the type having a plurality of insulated signal conductors arranged generally side-by-side and fixed in the cable means of woven warp and weft elements so that the center-to-center spacing of signal conductors are fixed in a prescribed first weave pattern, said cable including a number of ground conductors woven in said first weave pattern, and the improvement comprises weaving a termination section at each end of said cable which includes said weaving said signal conductors with said warp and weft yarns in a second weave pattern without said ground conductors so that said ground conductors are unbound and floated out of the second weave pattern of said cable with said signal conductors remaining in said second weave pattern of said cable, severing said ground conductors across the width of said woven cable at said termination section to form loose free ground conductors, electrically connecting said ground connectors in common to a ground means, inserting an insulation displaceable connector into said woven cable to pierce the insulated signal conductors fixed in said cable with a prescribed center-to-center spacing; and connecting said ground measns to said insulation displaceable connector in a manner that said ground wires and signal wires are compactly and conveniently terminated to said connector.

17. The method of claim 16 including weaving a cut-line section adjacent each said termination section consisting of said ground conductors and signal conductors interwoven in said weave pattern.

18. A method of producing individual flat woven electrical transmission cables having multiple insulated ground and insulated signal conductors woven generally side-by-side in a prescribed first weave pattern which includes a weft element of the type wherein continuous length woven cabling is woven in said prescribed weave pattern and severed into individual cable wherein the improvement comprises:

weaving a number of woven transmission cables with said conductors woven in said prescribed first weave pattern;

weaving a termination section consisting of only said signal conductors woven with said warp and weft yarns in a second weave pattern which said ground conductors are floated out of said second weave pattern above the plane of said woven cable;

weaving a cut-line section between adjacent termination sections consisting of said ground and signal conductors woven in said weave pattern;

severing said ground conductors across each said termination section and connecting said ground conductors to a bus bar;

inserting an insulation displaceable connector having pin sockets and termination prongs into each said cutline section in a manner that said termination prongs pierce the insulation on said signal conductors; and connecting said bus bar to one of said pin sockets of said insulation displaceable connector.

* * * * *